US009868616B2

(12) United States Patent
Kato

(10) Patent No.: US 9,868,616 B2
(45) Date of Patent: Jan. 16, 2018

(54) DOUBLE-DECK ELEVATOR

(75) Inventor: Kunio Kato, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 261 days.

(21) Appl. No.: 14/412,011

(22) PCT Filed: Aug. 14, 2012

(86) PCT No.: PCT/JP2012/070693

§ 371 (c)(1),
(2), (4) Date: Dec. 30, 2014

(87) PCT Pub. No.: WO2014/027398

PCT Pub. Date: Feb. 20, 2014

(65) Prior Publication Data

US 2015/0122591 A1 May 7, 2015

(51) Int. Cl.
*B66B 11/02* (2006.01)
*B66B 5/12* (2006.01)

(52) U.S. Cl.
CPC ..... *B66B 11/022* (2013.01); *B66B 5/12* (2013.01)

(58) Field of Classification Search
CPC ..... B66B 11/022; B66B 5/12
See application file for complete search history.

(56) References Cited

U.S. PATENT DOCUMENTS

| | | | | |
|---|---|---|---|---|
| 2001/0014996 | A1 | 8/2001 | Ericson et al. | |
| 2006/0249337 | A1 | 11/2006 | McNamara et al. | |
| 2008/0289907 | A1 * | 11/2008 | Kontturi | B66B 1/425 187/247 |

FOREIGN PATENT DOCUMENTS

| | | | | |
|---|---|---|---|---|
| CN | 1234362 | A | 11/1999 | |
| CN | 1771185 | A | 5/2006 | |
| EP | 3037375 | A1 * | 6/2016 | B66B 5/02 |
| JP | 60-64968 | | 5/1985 | |
| JP | 2002-534644 | | 10/2002 | |
| JP | 2006-526555 | | 11/2006 | |
| JP | 2007-331871 | | 12/2007 | |
| JP | 2009-196735 | | 9/2009 | |
| JP | 2011-158095 | A | 8/2011 | |
| JP | 2012-62124 | | 3/2012 | |
| WO | WO 0238482 | A1 * | 5/2002 | B66B 5/12 |

(Continued)

OTHER PUBLICATIONS

International Search Report dated Dec. 4, 2012, in PCT/JP12/070693 filed Aug. 14, 2012.

(Continued)

*Primary Examiner* — William E Dondero
*Assistant Examiner* — Diem M Tran
(74) *Attorney, Agent, or Firm* — Oblon, McClelland, Maier & Neustadt, L.L.P.

(57) ABSTRACT

In a double-deck elevator, a car apparatus includes: a main frame; an upper car and a lower car that are disposed inside the main frame so as to be able to move vertically; and a car suspending body that suspends the upper car and the lower car on the main frame so as to counterbalance each other. A stopper sheave is disposed on a lower portion of the main frame. A flexible stopper cord-like body is wound onto the stopper sheave. The stopper cord-like body is connected to the upper car on a first side of the stopper sheave and is connected to the lower car on a second side of the stopper sheave.

2 Claims, 6 Drawing Sheets

(56) References Cited

FOREIGN PATENT DOCUMENTS

| | | | | |
|---|---|---|---|---|
| WO | WO 2007/074206 A1 | 7/2007 | | |
| WO | WO 2012127683 A1 * | 9/2012 | ..... | B66B 5/18 |
| WO | WO 2016087530 A1 * | 6/2016 | ..... | B66B 5/02 |

OTHER PUBLICATIONS

Combined Office Action and Search Report dated Nov. 4, 2015 in Chinese Patent Application No. 201280075310.9 (with partial English language translation and English translation of categories of cited documents).

* cited by examiner

DOUBLE-DECK ELEVATOR

TECHNICAL FIELD

The present invention relates to a double-deck elevator in which an upper car and a lower car are suspended inside a main frame by a car suspending body.

BACKGROUND ART

In conventional double-deck elevators, an upper car and a lower car are moved vertically inside a main frame to adjust spacing between the upper car and the lower car by a driving force from a car position adjustment driving apparatus that is mounted to the main frame. A rope that suspends the upper car and the lower car inside the main frame is wound onto a car position adjustment driving sheave of the car position adjustment driving apparatus. A pair of upper car suspending sheaves onto which the rope is wound are mounted to a lower portion of the upper car, and a pair of lower car suspending sheaves onto which the rope is wound are mounted to a lower portion of the lower car (see Patent Literature 1, for example).

CITATION LIST

Patent Literature

[Patent Literature 1]
Japanese Patent Laid-Open No. 2007-331871 (Gazette)

SUMMARY OF THE INVENTION

Problem to be Solved by the Invention

In conventional double-deck elevators such as that described above, if a counterweight is stopped suddenly during ascent of the car apparatus, i.e., during descent of the counterweight, due to a counterweight safety device being activated or the counterweight colliding into a buffer, the car apparatus may continue ascending even if the tension of the main rope that suspends it is lost, and the tension of the main rope may subsequently be restored when the car apparatus falls.

Now, because the upper car and the lower car are suspended on the main frame of the car apparatus by a rope, if the tension of the main rope is lost, and the car apparatus continues ascending, the tension of the rope that suspends the upper car and the lower car may also be lost, and the upper car and the lower car ascend relative to the main frame. Because of that, when the car apparatus falls, and the rope the tension is restored, mechanical shock that acts on the upper car and the lower car is greater than mechanical shock that acts on the main frame.

The present invention aims to solve the above problems and an object of the present invention is to provide a double-deck elevator that can suppress mechanical shock that acts on an upper car and a lower car after a counterweight is stopped suddenly during descent.

Means for Solving the Problem

In order to achieve the above object, according to one aspect of the present invention, there is provided a double-deck elevator including: a car apparatus including: a main frame; an upper car that is disposed inside the main frame so as to be able to move vertically; a lower car that is disposed inside the main frame below the upper car so as to be able to move vertically; and a car suspending body that suspends the upper car and the lower car on the main frame so as to counterbalance each other, the car apparatus being raised and lowered inside a hoistway, wherein: the car apparatus further includes: a stopper sheave that is disposed on a lower portion of the main frame; and a flexible stopper cord-like body that is wound onto the stopper sheave; and the stopper cord-like body is connected to the upper car on a first side of the stopper sheave, and is connected to the lower car on a second side of the stopper sheave.

Effects of the Invention

In the double-deck elevator according to the present invention, because the stopper sheave is disposed on the lower portion of the main frame, and the stopper cord-like body is wound onto the stopper sheave, and the stopper cord-like body is connected to the upper car on the first side of the stopper sheave, and is connected to the lower car on the second side of the stopper sheave, the upper car and the lower car are prevented from being raised simultaneously relative to the main frame due to tension being lost in the car suspending body, enabling mechanical shock that acts on the upper car and the lower car after a counterweight is stopped suddenly during descent to be suppressed.

DESCRIPTION OF EMBODIMENTS

A preferred embodiment of the present invention will now be explained with reference to the drawings.

Embodiment 1

Figure 1:
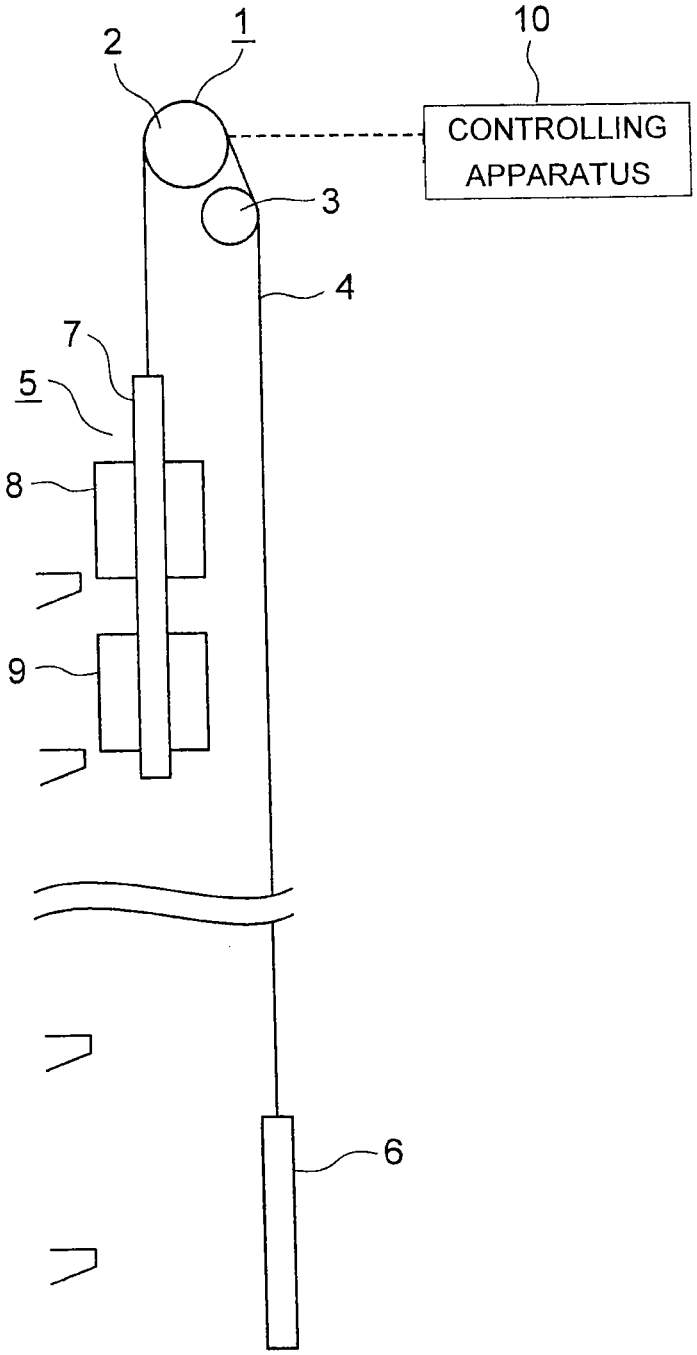
FIG. 1 is a schematic configuration diagram that shows a double-deck elevator according to Embodiment 1 of the present invention.

FIG. 1 is a schematic configuration diagram that shows a double-deck elevator according to Embodiment 1 of the present invention. In the figure, a hoisting machine 1 is disposed in an upper portion of a hoistway. The hoisting machine 1 has: a hoisting machine driving sheave 2; a hoisting machine motor (not shown) that rotates the hoisting machine driving sheave 2; and a hoisting machine brake 3*b* (not shown) that brakes rotation of the driving sheave.

A deflecting sheave 3 is disposed in a vicinity of the hoisting machine driving sheave 2. A plurality of car apparatus suspending ropes 4 that function as a car apparatus suspending body are wound around the hoisting machine driving sheave 2 and the deflecting sheave 3.

A car apparatus 5 and a counterweight 6 are suspended inside the hoistway by the car apparatus suspending ropes 4 using a one-to-one (1:1) roping method, and are raised and lowered inside the hoistway by the hoisting machine 1. A pair of car apparatus guide rails (not shown) that guide raising and lowering of the car apparatus 5 and a pair of counterweight guide rails (not shown) that guide raising and lowering of the counterweight 6 are installed inside the hoistway 1.

A car apparatus safety device (not shown) that engages with a car apparatus guide rail to make the car apparatus 5 perform an emergency stop is mounted to the car apparatus 5. A counterweight safety device (not shown) that is a braking apparatus that engages mechanically with a counterweight guide rail to make the counterweight 6 perform an emergency stop is mounted to the counterweight 6.

The car apparatus 5 has: a main frame (a car apparatus frame) 7 that is connected to the car apparatus suspending ropes 4; an upper car 8 that is disposed in an upper portion inside the main frame 7; and a lower car 9 that is disposed in a lower portion inside the main frame 7, i.e., directly below the upper car 8. The upper car 8 and the lower car 9 are both movable vertically relative to the main frame 7. Spacing between the upper car 8 and the lower car 9 is adjustable by moving the upper car 8 and the lower car 9 vertically relative to the main frame 7.

Operation of the hoisting machine 1 is controlled by a controlling apparatus 10. In other words, the controlling apparatus 10 controls movement of the car apparatus 5. The controlling apparatus 10 also controls the spacing between the upper car 8 and the lower car 9 in response to the floors at which the upper car 8 and the lower car 9 arrive.

Figure 2:
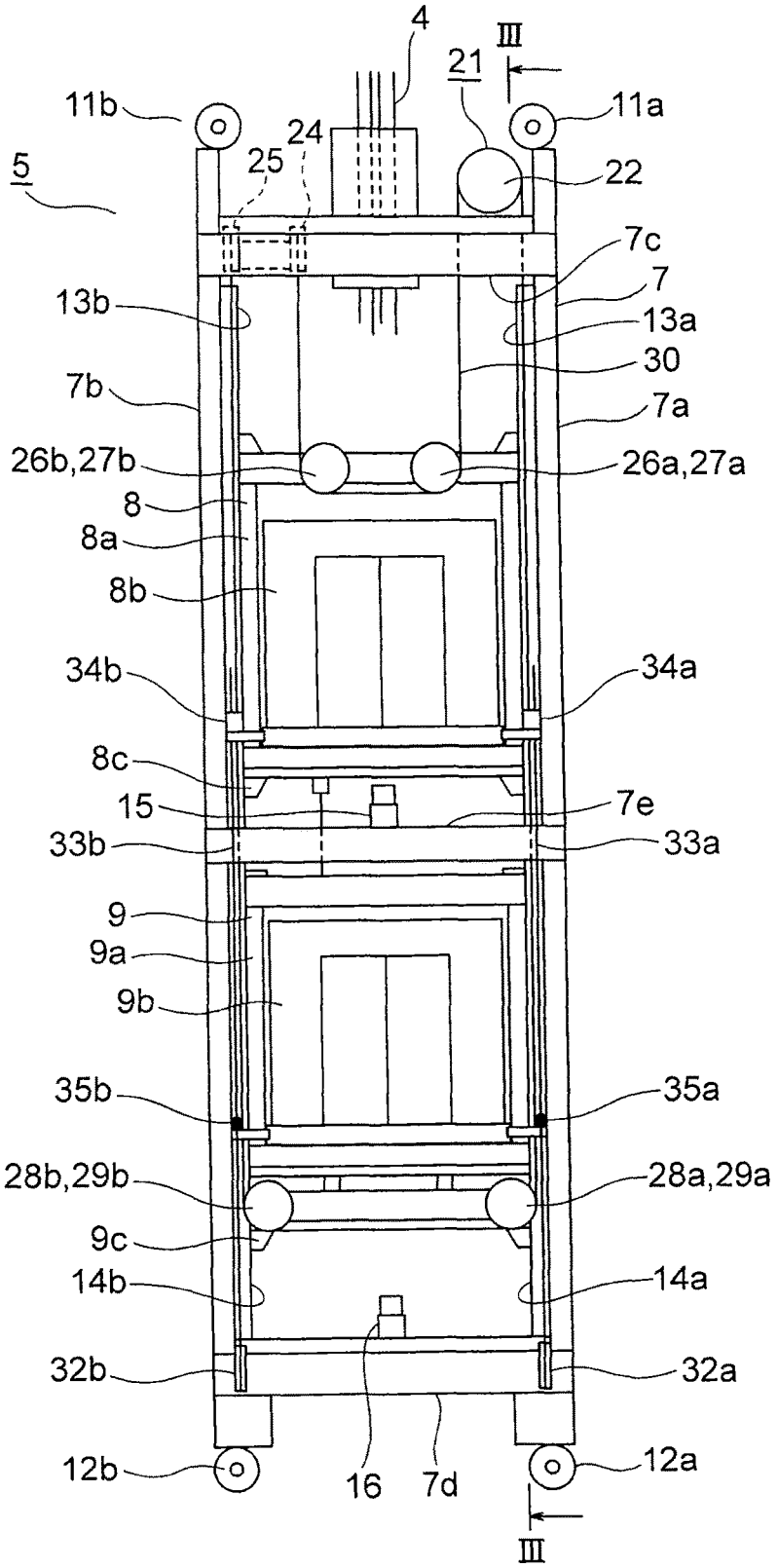
FIG. 2 is a front elevation that shows a car apparatus from FIG. 1 enlarged.
Figure 3:
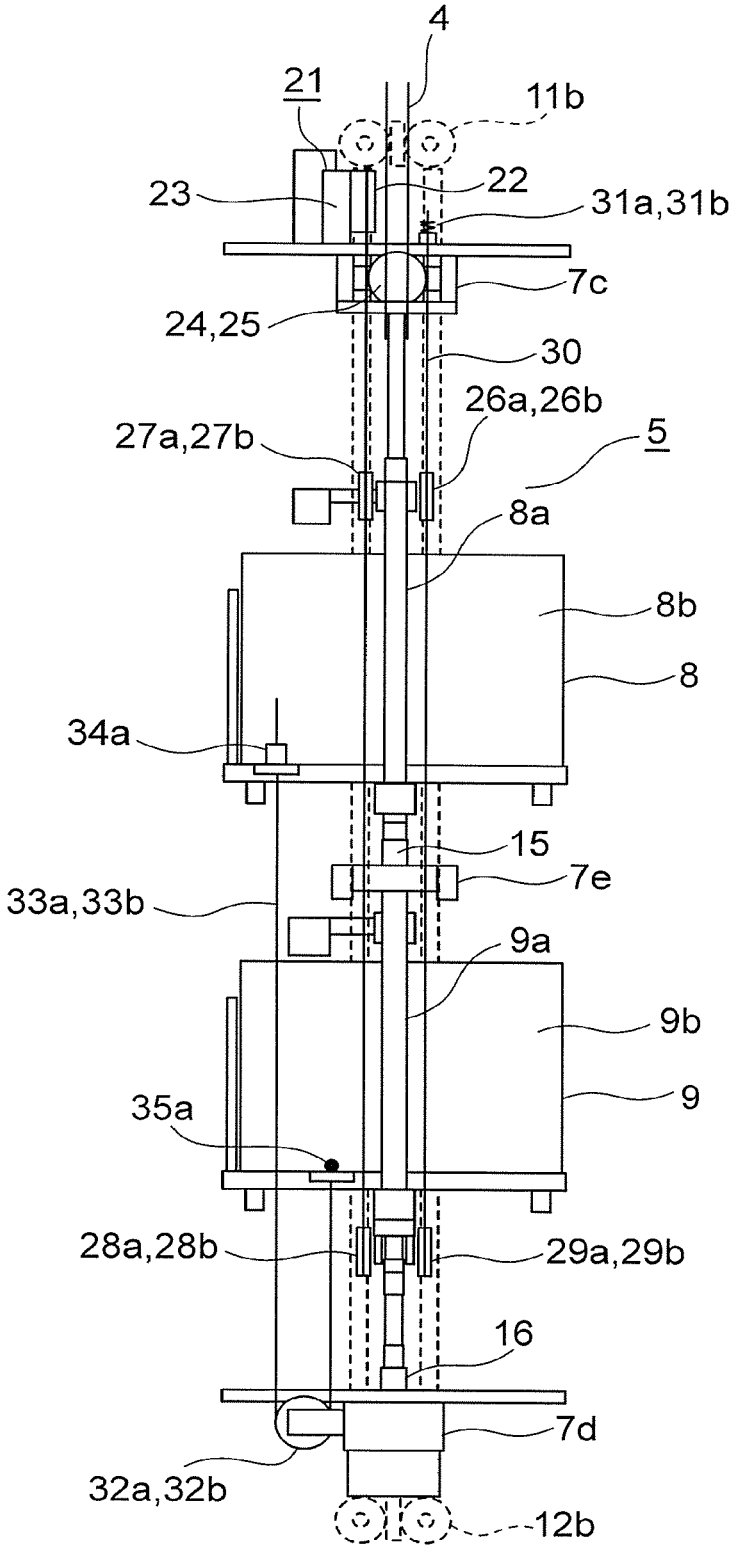
FIG. 3 is a cross section that is taken along Line III-III in FIG. 2.

FIG. 2 is a front elevation that shows a car apparatus 5 from FIG. 1 enlarged, and FIG. 3 is a cross section that is taken along Line III-III in FIG. 2. The main frame 7 has: a pair of vertical frames 7*a* and 7*b*; an upper frame 7*c* that is disposed horizontally between upper end portions of the vertical frames 7*a* and 7*b*; a lower frame 7*d* that is disposed horizontally between lower end portions of the vertical frames 7*a* and 7*b*; and an intermediate frame 7*e* that is disposed horizontally between intermediate portions of the vertical frames 7*a* and 7*b*. The car apparatus suspending ropes 4 are connected to the upper frame 7*c*.

A pair of upper portion roller guiding apparatuses 11*a* and 11*b* that engage with the car apparatus guide rails are disposed on two width direction ends of an upper end portion of the main frame 7. A pair of lower portion roller guiding apparatuses 12*a* and 12*b* that engage with the car apparatus guide rails are disposed on two width direction ends of a lower end portion of the main frame 7.

The upper car 8 is disposed between the upper frame 7*c* and the intermediate frame 7*e*. The lower car 9 is disposed between the intermediate frame 7*e* and the lower frame 7*d*. Disposed on the vertical frames 7*a* and 7*b* are: a pair of upper car guide rails 13*a* and 13*b* that guide vertical movement of the upper car 8; and a pair of lower car guide rails 14*a* and 14*b* that guide vertical movement of the lower car 9.

The upper car 8 has: an upper car frame 8*a*; an upper cage 8*b* that is supported by the upper car frame 8*a*; and a plurality of upper car guiding shoes 8*c* that engage with the upper car guide rails 13*a* and 13*b*. The lower car 9 has: a lower car frame 9*a*; a lower cage 9*b* that is supported by the lower car frame 9*a*; and a plurality of lower car guiding shoes 9*c* that engage with the lower car guide rails 14*a* and 14*b*.

An upper car buffer 15 is installed on the intermediate frame 7*e*. A lower car buffer 16 is installed on the lower frame 7*d*.

A car position adjustment driving apparatus 21 that changes spacing between the upper car 8 and the lower car 9 by moving the two vertically is disposed on the upper frame 7*c*. The car position adjustment driving apparatus 21 changes a distance between a car floor of the upper car 8 and a car floor of the lower car 9 to match distances between building floors.

The car position adjustment driving apparatus 21 has: a car position adjustment driving sheave 22; and a car position adjusting motor 23 that rotates the car position adjustment driving sheave 22. First and second return sheaves 24 and 25 are disposed on the upper frame 7*c*.

A pair of first upper car suspending sheaves 26*a* and 26*b* and a pair of second upper car suspending sheaves 27*a* and 27*b* are disposed on an upper portion of the upper car frame 8*a*. A pair of first lower car suspending sheaves 28*a* and 28*b* and a pair of second lower car suspending sheaves 29*a* and 29*b* are disposed on a lower portion of the lower car frame 9*a*.

The first upper car suspending sheave 26*a* and the second upper car suspending sheave 27*a* are disposed coaxially so as to be rotatable independently from each other. The first upper car suspending sheave 26*b* and the second upper car suspending sheave 27*b* are disposed coaxially so as to be rotatable independently from each other. The second upper car suspending sheaves 27*a* and 27*b* are disposed in front of the first upper car suspending sheaves 26*a* and 26*b* (to the left in FIG. 3) in the depth direction of the car apparatus 5.

The first lower car suspending sheave 28*a* and the second lower car suspending sheave 29*a* are disposed coaxially so as to be rotatable independently from each other. The first lower car suspending sheave 28*b* and the second lower car suspending sheave 29*b* are disposed coaxially so as to be rotatable independently from each other. The second lower car suspending sheaves 29*a* and 29*b* are disposed behind the first lower car suspending sheaves 28*a* and 28*b* (to the right in FIG. 3) in the depth direction of the car apparatus 5.

The rotating shafts of the car position adjustment driving sheave 22, the return sheaves 24 and 25, and the suspending sheaves 26*a*, 26*b*, 27*a*, 27*b*, 28*a*, 28*b*, 29*a*, and 29*b* are each horizontal.

A plurality of car suspending ropes 30 that function as a car suspending body that suspend the upper car 8 and the lower car 9 on the main frame 7 so as to counterbalance each other are wound onto the car position adjustment driving sheave 22. A first rope fastening portion 31*a* to which first end portions of the car suspending ropes 30 are connected, and a second rope fastening portion 31*b* to which second end portions of the car suspending ropes 30 are connected, are disposed on the upper frame 7*c*.

The car suspending ropes 30 are wound sequentially from near the first end portions around the first upper car suspending sheave 26*a*, the first upper car suspending sheave 26*b*, the first return sheave 24, the second upper car suspending sheave 27*b*, the second upper car suspending sheave 27*a*, the car position adjustment driving sheave 22, the first lower car suspending sheave 28*a*, the first lower car suspending sheave 28*b*, the second return sheave 25, the second lower car suspending sheave 29*b*, and the second lower car suspending sheave 29*a*, and extend to the second end portions. The upper car 8 and the lower car 9 are thereby suspended on the main frame 7 by a four-to-one (4:1) roping method.

A floor spacing adjusting apparatus according to Embodiment 1 includes the car position adjustment driving apparatus 21, the return sheaves 24 and 25, the suspending sheaves 26*a*, 26*b*, 27*a*, 27*b*, 28*a*, 28*b*, 29*a*, and 29*b*, and the car suspending ropes 30.

Stopper sheaves 32*a* and 32*b* are disposed on lower portions of the main frame 7, specifically, on two ends in a width direction of the lower frame 7*d*. Flexible stopper ropes 33*a* and 33*b* that function as stopper cord-like bodies are wound onto the stopper sheaves 32*a* and 32*b*. In other words, stopper sheaves according to Embodiment 1 include the pair of left and right stopper sheaves 32*a* and 32*b*, and stopper cord-like bodies according to Embodiment 1 include the pair of left and right stopper ropes 33*a* and 33*b*.

The stopper ropes 33*a* and 33*b* are connected to the upper car 8 on a first side of the stopper sheaves 32*a* and 32*b*. Specifically, first end portions (upper car end portions) of the stopper ropes 33*a* and 33*b* are connected to a lower portion of the upper car frame 8*a* by means of clamping apparatuses 34*a* and 34*b*.

The stopper ropes 33*a* and 33*b* are connected to the lower car 9 on a second side of the stopper sheaves 32*a* and 32*b*. Specifically, second end portions (lower car end portions) of the stopper ropes 33*a* and 33*b* are connected to a lower portion of the lower car frame 9*a* by means of rope terminal connecting apparatuses 35*a* and 35*b*.

The stopper ropes 33*a* and 33*b* are moved, and the stopper sheaves 32*a* and 32*b* rotated, by the spacing between the upper car 8 and the lower car 9 being changed.

Loading conditions that act on the stopper ropes 33*a* and 33*b* are different than those of the car apparatus suspending ropes 4 and the car suspending ropes 30 on which large tensions act constantly, and are closer to those of a speed governor rope (not shown). Because of that, a safety factor of the stopper ropes 33*a* and 33*b* can be set based on the safety factor of the speed governor rope.

In Embodiment 1, strengths of the stopper ropes 33*a* and 33*b* are set to approximately one fifth to one tenth of a strength of the car suspending ropes 30. For example, five ropes that have a diameter of 10 mm may be used as the car suspending ropes 30. In that case, because the roping method is four-to-one (4:1), the upper car 8 and the lower car 9 are suspended by a total of twenty ropes that have a diameter of 10 mm. In contrast to that, a total of two ropes (one each on the left and right) that have a diameter of 12 mm are used as the stopper ropes 33*a* and 33*b*.

Stopper sheaves 32*a* and 32*b* that are based on speed governor sheaves can be used, in a similar manner to the stopper ropes 33*a* and 33*b*. In Embodiment 1, a ratio between a diameter of the stopper ropes 33*a* and 33*b* and a diameter of the stopper sheaves 32*a* and 32*b* is set to greater than or equal to 30. If the diameter of the stopper ropes 33*a* and 33*b* is 12 mm, and the diameter of the stopper sheaves 32*a* and 32*b* is 380 mm, for example, then that ratio is approximately 31.7.

Figure 4:
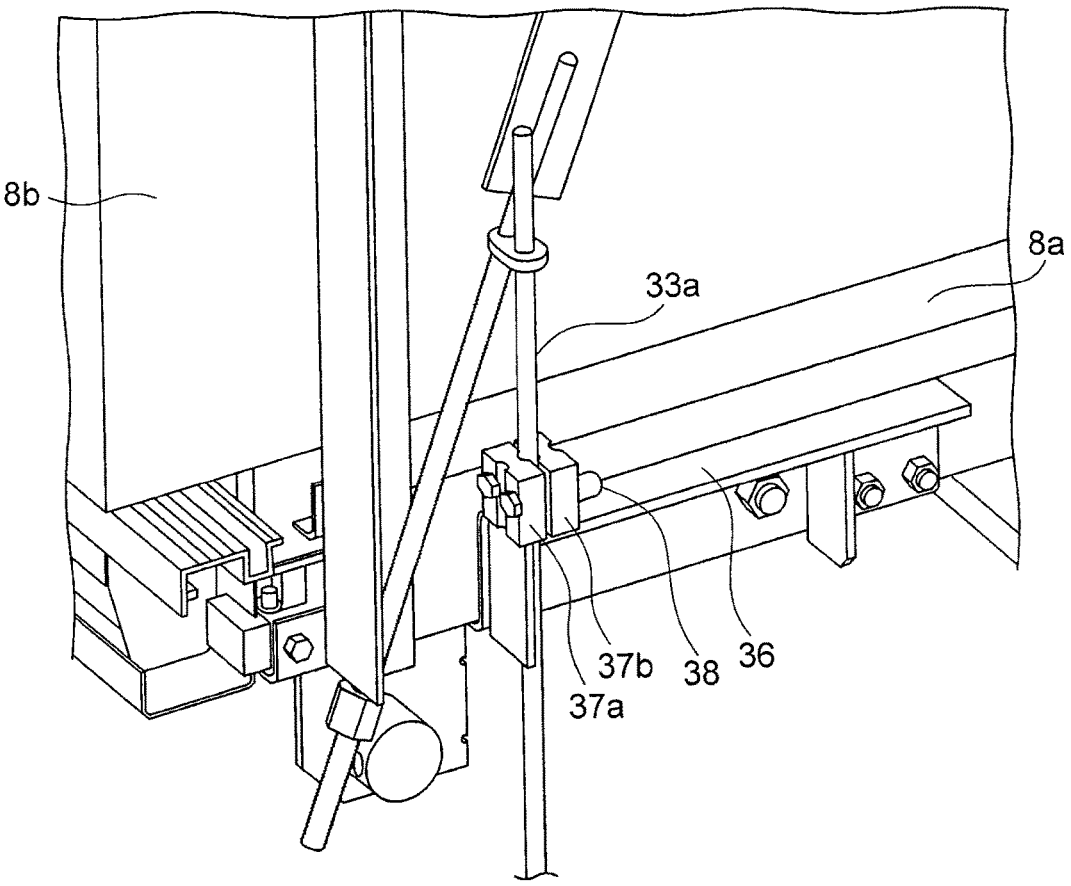
FIG. 4 is an oblique projection that shows a clamping apparatus from FIG. 3 enlarged.

FIG. 4 is an oblique projection that shows a clamping apparatus 34*a* from FIG. 3 enlarged, configuration of the clamping apparatus 34*b* also being similar or identical to that of the clamping apparatus 34*a*. The clamping apparatus 34*a* has: a mounting member 36 that is fixed to a lower portion of the upper car frame 8*a*; a pair of clamping members 37*a* and 37*b* that are made of an aluminum alloy, that are disposed on the mounting member 36; and a pair of locking bolts 38 that fasten the clamping member 37*a* and 37*b*.

The first end portion of the stopper rope 33*a* is held between the clamping members 37*a* and 37*b*. The clamping force by the locking bolts 38 is managed so as to allow the stopper rope 33*a* to slide relative to the clamping members 37*a* and 37*b* if the ascent energy of the upper car 8 and the lower car 9 is excessive when the counterweight 6 is stopped suddenly during descent. In other words, the maximum tension that acts on the stopper rope 33*a* is a clamping force from the clamping members 37*a* and 37*b* on the stopper rope 33*a*.

By allowing the stopper rope 33*a* to slide relative to the clamping members 37*a* and 37*b* in this manner, energy is absorbed, suppressing ascent of the upper car 8 and the lower car 9 relative to the main frame 7. This is also effective in preventing damage to the elevator apparatus itself if an unexpected load acts on the stopper sheave 32*a* and the stopper rope 33*a*.

Figure 5:
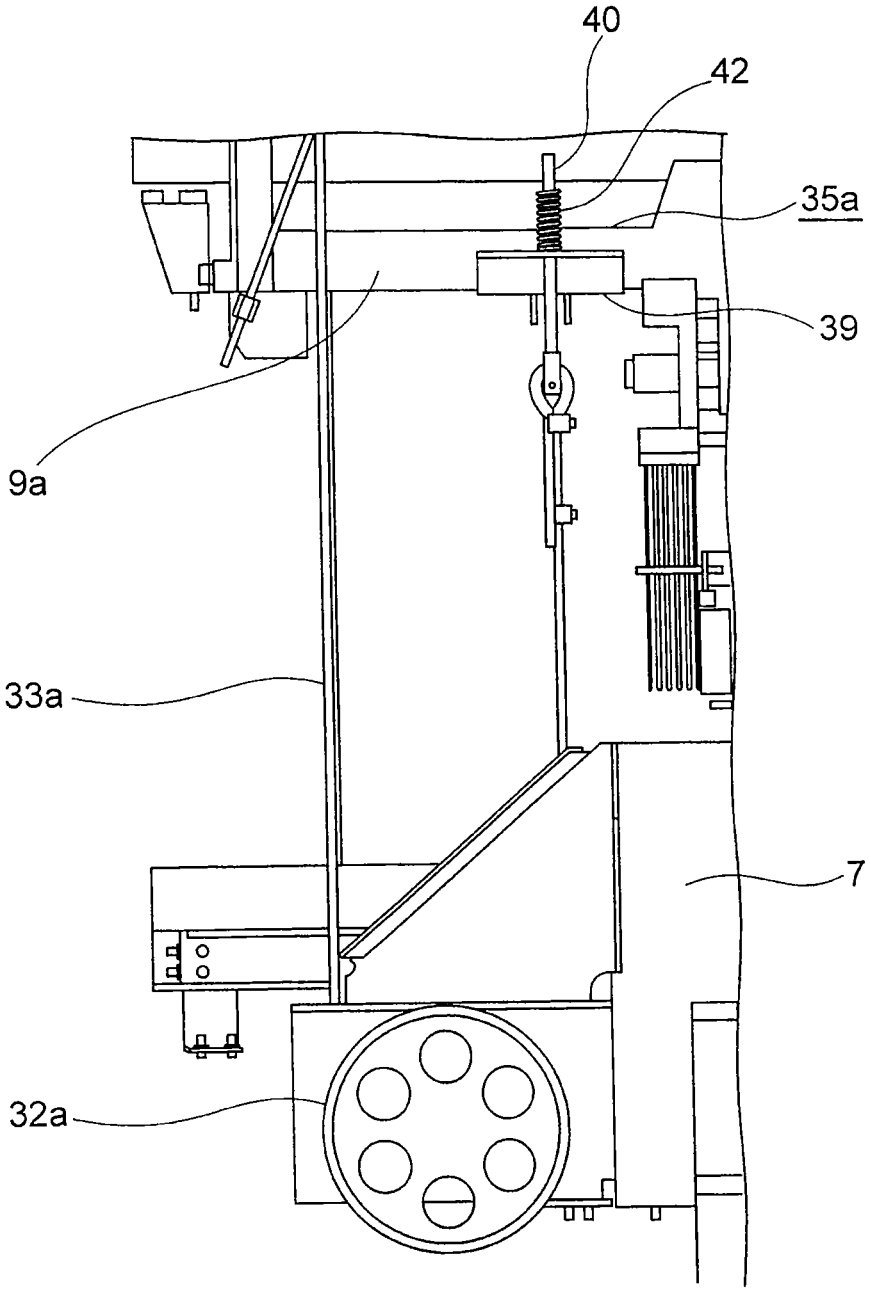
FIG. 5 is a side elevation that shows part of FIG. 3 enlarged.
Figure 6:
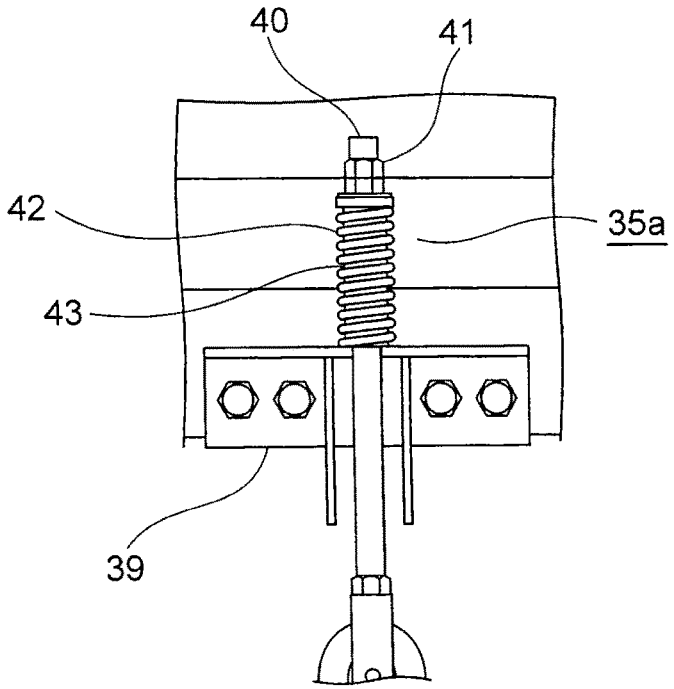
FIG. 6 is a front elevation that shows a rope terminal connecting apparatus from FIG. 5.

FIG. 5 is a side elevation that shows part of FIG. 3 enlarged, and FIG. 6 is a front elevation that shows a rope terminal connecting apparatus 35*a* from FIG. 5, configuration of the rope terminal connecting apparatus 35*b* also being similar or identical to that of the rope terminal connecting apparatus 35*a*. The rope terminal connecting apparatus 35*a* has: a mounting member 39 that is fixed to the lower car frame 9*a*; a screw-threaded rod 40 that passes through the mounting member 39; a plurality of nuts 41 that are screwed onto an upper end portion of the screw-threaded rod 40; a spring 42 that functions as an elastic body that is disposed between the mounting member 39 and the nuts 41; and a collar 43 that surrounds the screw-threaded rod 40 inside the spring 42.

Figure 7:
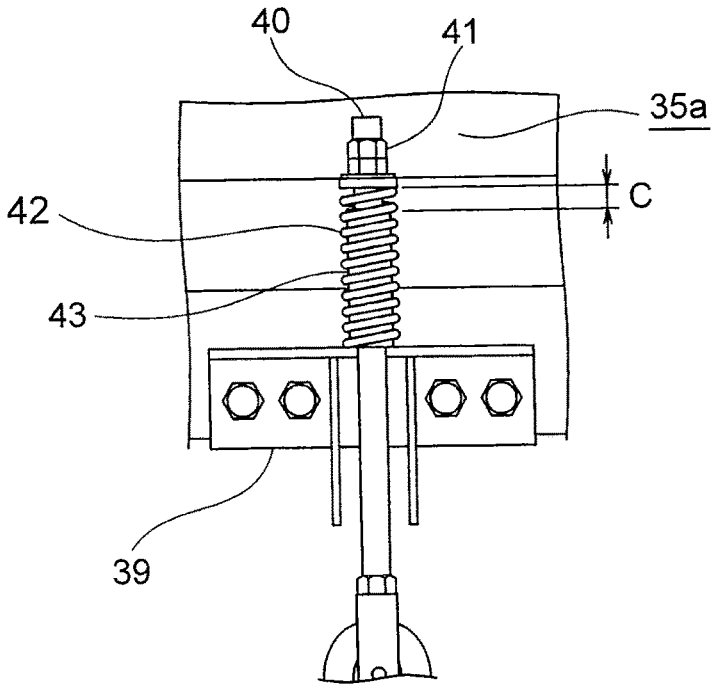
FIG. 7 is a front elevation that shows a state in which a spring from FIG. 6 has expanded.

The second end portion of the stopper rope 33*a* is connected to a lower end portion of the screw-threaded rod 40. Age-related stretching of the car suspending ropes 30 and the stopper ropes 33*a* and 33*b* is absorbed by the force of recovery of the spring 42, as shown in FIG. 7. The stopper ropes 33*a* and 33*b* are thereby prevented from dislodging from the stopper sheaves 32*a* and 32*b*.

During maintenance, a gap C between an upper end portion of the spring 42 and an upper end portion of the collar 43 is measured. The nut 41 is fastened before the gap C reaches a preset value, to set the gap C to 0 mm.

Because stretching of the car suspending ropes 30 is small, the gap C is estimated to be less than 18 mm one year after installation. In that case, the maximum value of the gap C may be set to 20 mm, for example, and fastening of the nut 41 should be performed during regular maintenance inspections before the gap C reaches 20 mm.

In a double-deck elevator of this kind, because the stopper sheaves 32*a* and 32*b* are disposed on the lower portion of the main frame 7, and the stopper ropes 33*a* and 33*b* are wound onto the stopper sheaves 32*a* and 32*b*, and the stopper ropes 33*a* and 33*b* are connected to the upper car 8 and the lower car 9, the upper car 8 and the lower car 9 can be prevented from being raised simultaneously relative to the main frame 7 due to tension being lost in the car suspending ropes 30, enabling the mechanical shock that acts on the upper car 8 and the lower car 9 after the counterweight 6 is stopped suddenly during ascent to be suppressed.

Because the stopper sheaves 32*a* and 32*b* and the stopper ropes 33*a* and 33*b* are disposed so as to be biased toward the front of the upper car 8 and the lower car 9, unbalanced loads toward the front act on the upper car 8 and the lower car 9 when ascent of the upper car 8 and the lower car 9 relative to the main frame 7 is prevented. Frictional resistance at the upper car guiding shoes 8*c* and the lower car guiding shoes 9*c* is thereby increased, enabling ascent of the upper car 8 and the lower car 9 relative to the main frame 7 to be prevented more reliably.

In addition, because the stopper sheaves 32*a* and 32*b* are disposed on the left and right sides of the main frame 7, and the stopper ropes 33*a* and 33*b* are disposed on the left and right sides of the upper car 8 and the lower car 9, they can be easily retrofitted to an existing double-deck elevator that has a counterbalanced floor spacing adjusting apparatus without increasing overall length of the car apparatus 5.

Moreover, in the above example, the clamping apparatuses 34*a* and 34*b* are disposed on end portions of the stopper ropes 33*a* and 33*b* near the upper car 8, and the rope terminal connecting apparatuses 35*a* and 35*b* are disposed on end portions near the lower car 9, but that may be reversed.

In the above example, the stopper sheaves 32*a* and 32*b* and the stopper ropes 33*a* and 33*b* are disposed so as to be biased toward the front of the upper car 8 and the lower car 9, but may be disposed so as to be biased toward the rear.

In addition, in the above example, the car apparatus suspending ropes 4 are shown as the car apparatus suspending body, and the car suspending ropes 30 as the car suspending body, but these are not limited to ropes, and may be belts, for example.

Furthermore, in the above example, the stopper ropes 33*a* and 33*b* were shown as the stopper cord-like bodies, but the stopper cord-like bodies are not limited to ropes, and may be belts or single-strand wires, for example.

In the above example, two sets of stopper sheaves 32*a* and 32*b* and stopper ropes 33*a* and 33*b* are shown, but there may be one set or three or more sets.

In addition, in the above example, the upper car 8 and the lower car 9 are suspended by a four-to-one (4:1) roping method, but are not limited to this, and may be suspended by a two-to-one (2:1) roping method, for example.

Furthermore, the overall configuration of the double-deck elevator is not limited to the example in FIG. 1.

The invention claimed is:

1. A double-deck elevator comprising:

a car apparatus including:

a main frame;

an upper car that is disposed inside the main frame so as to be able to move vertically;

a lower car that is disposed inside the main frame below the upper car so as to be able to move vertically; and a car suspending body that suspends the upper car and the lower car on the main frame so as to counterbalance each other, the car apparatus being raised and lowered inside a hoistway, wherein:

the car apparatus further includes:

a stopper sheave that is disposed on a lower portion of the main frame below the lower car; and a flexible stopper cord-like body that is wound onto the stopper sheave;

the stopper cord-like body is connected to the upper car on a first side of the stopper sheave, and is connected to the lower car on a second side of the stopper sheave;

the stopper cord-like body is connected to the upper car or the lower car by means of a clamping apparatus that holds the stopper cord-like body;

the clamping apparatus includes a mounting member that is fixed to the upper car or the lower car;

a pair of clamping members that are disposed on the mounting member; and a locking bolt that fastens the clamping members; and the clamping force by the locking bolt can be adjusted so as to allow the stopper cord-like body to slide relative to the clamping members if the ascent energy of the upper car and the lower car relative to the main frame is excessive.

2. A double-deck elevator comprising:

a car apparatus including:

a main frame;

an upper car that is disposed inside the main frame so as to be able to move vertically;

a lower car that is disposed inside the main frame below the upper car so as to be able to move vertically in a vertical direction, the upper car being higher in the vertical direction than the lower car; and a car suspending body that suspends the upper car and the lower car on the main frame so as to counterbalance each other, the car apparatus being raised and lowered inside a hoistway, wherein:

the car apparatus further includes:

a stopper sheave that is disposed on a lower portion of the main frame; and a flexible stopper cord-like body that is wound onto the stopper sheave;

the stopper cord-like body is connected to the upper car on a first side of the stopper sheave, and is connected to the lower car on a second side of the stopper sheave;

the stopper cord-like body is connected to the upper car or the lower car by means of a terminal connecting apparatus, wherein:

the terminal connecting apparatus further includes:

a mounting member;

a screw-threaded rod that passes through the mounting member;

a nut that is screwed onto an upper end portion of the screw-threaded rod;

an elastic body that is disposed between the mounting member and the nut and that absorbs stretching of the car suspending body and the stopper cord-like body; and a collar that is disposed on the mounting member and that surround the screw-threaded rod; and the stopper cord-like body is connected to a lower end portion of the screw-threaded rod, the lower end portion of the screw-threaded rod being lower in the vertical direction than the upper end portion of the screw-threaded rod.

* * * * *